US005172829A

United States Patent [19]

Dellicker, Jr.

[11] Patent Number: 5,172,829

[45] Date of Patent: Dec. 22, 1992

[54] AUTOMATED KEY DISPENSER

[75] Inventor: Henry A. Dellicker, Jr., Holliston, Mass.

[73] Assignee: Siemens Nixdorf Information Systems, Inc., Burlington, Mass.

[21] Appl. No.: 765,992

[22] Filed: Sep. 26, 1991

[51] Int. Cl.[5] ..... G07F 11/10

[52] U.S. Cl. ..... 221/13; 221/89; 221/124; 221/130; 221/131; 221/133; 221/195; 221/312 A

[58] Field of Search ..... 221/2, 3, 7, 8, 12, 221/13, 69, 89, 123, 124, 126, 129, 133, 194, 195, 130, 131, 268, 299, 312 A

[56] References Cited

U.S. PATENT DOCUMENTS

| | | | |
|---|---|---|---|
| 3,163,276 | 12/1964 | McLaughlin | 221/69 X |
| 3,248,005 | 4/1966 | Joschko | 221/129 X |
| 3,294,281 | 12/1966 | Schlaf | 221/9 |
| 3,979,017 | 9/1976 | O'Toole et al. | 221/7 |
| 4,010,868 | 3/1977 | Rese et al. | 221/312 A X |
| 4,120,452 | 10/1978 | Kimura et al. | 235/381 |
| 4,225,056 | 9/1980 | Flubacker | 221/2 |
| 4,573,606 | 3/1986 | Lewis et al. | 221/2 |
| 4,630,042 | 12/1986 | Kawasaki et al. | 340/825.35 |
| 4,631,358 | 12/1986 | Newcome, III et al. | 379/45 |
| 4,661,806 | 4/1987 | Peters et al. | 340/568 |
| 4,752,876 | 6/1988 | Couch et al. | 364/407 |
| 4,913,313 | 4/1990 | Rockda | 221/131 |
| 5,064,341 | 11/1991 | Pippin | 221/131 X |

FOREIGN PATENT DOCUMENTS

| | | |
|---|---|---|
| 1115975 | 10/1961 | Fed. Rep. of Germany . |
| 2624637 | 6/1989 | France . |

*Primary Examiner*—Robert P. Olszewski
*Assistant Examiner*—Dean A. Reichard
*Attorney, Agent, or Firm*—Weingarten, Schurgin, Gagnebin & Hayes

[57] ABSTRACT

The present invention provides an automated key dispenser system that permits keys to be randomly loaded and stored on individual keyholders in horizontal and vertical arrays, as well as in a number of planes, while dispensing keys to a single accessible location. An exemplary system comprises one or more racks containing solenoid-operated pins arranged in columns and rows. The racks may be arranged side-by-side, one on top of another, or stacked in parallel planes. Awning-shaped covers over the pins prevent tampering and dislodgement of keys. The keys which are released when pins are withdrawn by the solenoids are directed by the awning-shaped covers to a chute which in turn directs them to an accessible opening or receptacle.

23 Claims, 6 Drawing Sheets

AUTOMATED KEY DISPENSER

FIELD OF THE INVENTION

The present invention relates to devices for dispensing articles, and more particularly to an automated device for dispensing keys.

BACKGROUND OF THE INVENTION

Automated devices such as the dispensing or vending machines disclosed in U.S. Pat. Nos. 3,979,017, 4,120,452, and 4,630,042 permit an article to be selected from a variety of articles and dispensed to an individual user or consumer.

U.S. Pat. Nos. 4,752,876, 4,661,806, and 4,631,358 disclose devices which dispense stored keys to an externally accessible location when a hotel guest "checks in". These key-dispensing devices are often more intricate than vending machines because of the small size of the keys. Key cartridges 330–336 are shown in U.S. Pat. No. 4,752,876, while individual keyholders with magnetic strips 440 are shown in U.S. Pat. No. 4,661,806. Such devices hinder the convenient loading and unloading of keys.

The key release mechanism of U.S. Pat. No. 4,631,358 uses a solenoid which moves a piston through two apertured walls in response to a computer-controlled relay unit. A key is hooked onto the piston between the walls, one of which is hinged to facilitate key loading, and the key is released when the piston is withdrawn through the apertures by the solenoid. However, the keys can only be loaded and stored in one horizontal row within the dispensing device. The number of keys which may be stored within a given space is, therefore, limited.

SUMMARY OF THE INVENTION

The present invention provides a totally random access modular, automated key dispenser system that permits keys to be loaded and stored on individual keyholders in horizontal and vertical arrays, as well as in a number of planes, while dispensing keys to a single accessible location. An exemplary system comprises one or more racks containing solenoid-operated pins arranged in columns and rows. The racks may be arranged side-by-side, one on top of another, or stacked in parallel planes. Awning-shaped covers over the pins prevent tampering and dislodgement of keys and interference by keys dispensed from other pins. Keys which are released when pins are withdrawn by the solenoids are directed by the awning-shaped covers to a chute which in turn directs them to an accessible opening or receptacle.

The invention may be used with conventional keys and identification tags, and does not require special key attachments for loading, storage, or dispensing. During regular business hours, the system can be used conventionally to hang keys in full view. At night, the system provides self-service through the aid of an internal computer, monitor, and protective enclosure.

In a further exemplary embodiment, sensors located on individual keyholders or pins can provide information to a computer unit. For example, the sensors provide information regarding which keys have not been removed, and, accordingly, which keys and associated hotel room, car, etc. are available.

DESCRIPTION OF THE DRAWINGS

A thorough understanding of attendant features and advantages of the invention may more readily be obtained by reference to the following detailed description when taken in conjunction with the drawings, wherein.

DETAILED DESCRIPTION OF THE INVENTION

Figure 1:
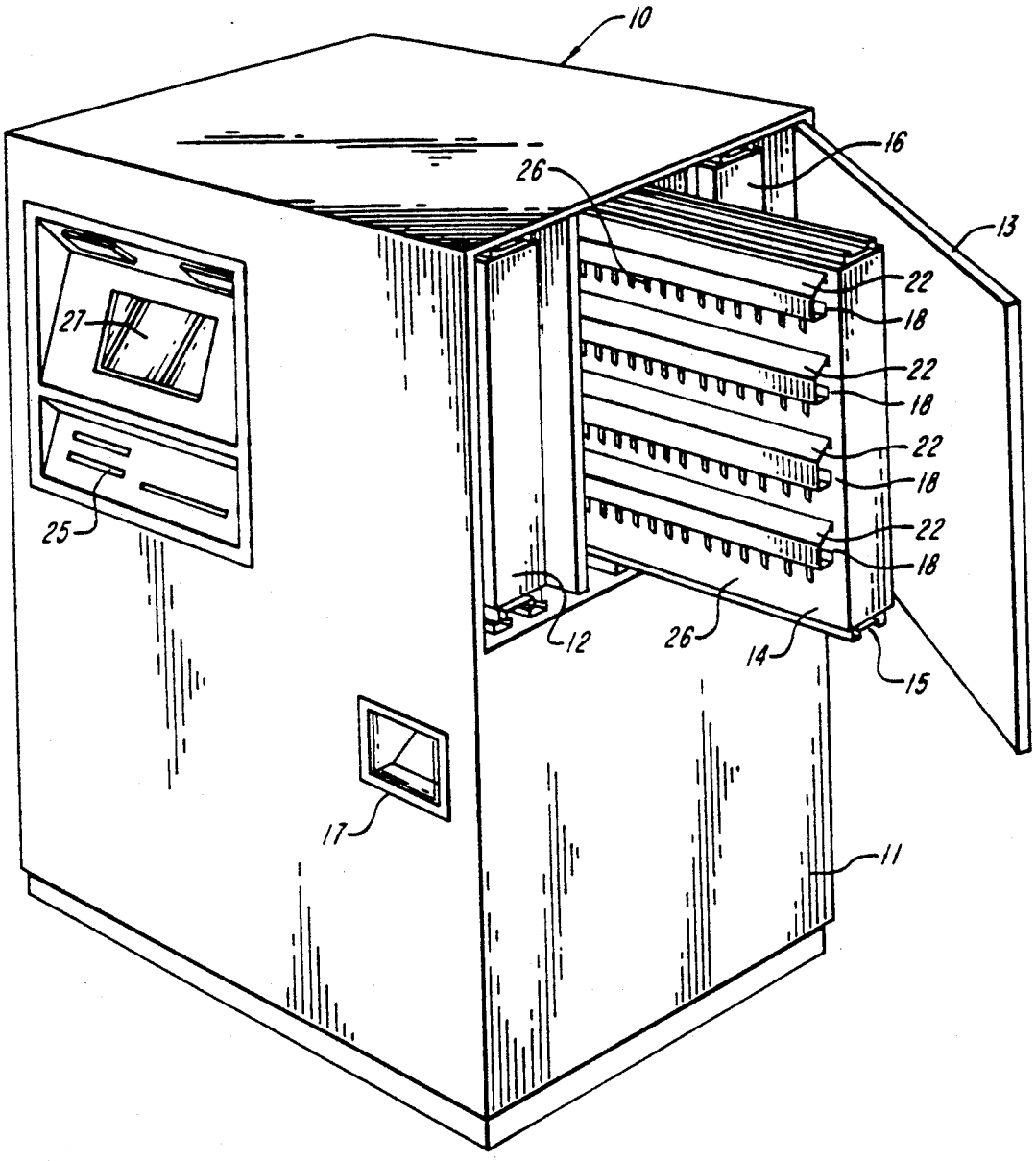
FIG. 1 is a perspective view of an exemplary automated key dispenser of the invention having racks for retaining keys.

FIG. 1 is a perspective view of an exemplary automated key dispenser 10 of the invention. The key dispenser is comprised of one or more racks 12,14 (shown partially withdrawn from cabinet 11), and 16 containing an array of keyholders 26, such as pins, shafts, or hooks arranged horizontally and vertically on the one or more racks. Keys (not shown) are accessible at the opening 17 of the cabinet 11 when released from the keyholders 26 and dispensed. The dispenser 10 permits self-service and is ideally suited for use in hotels, airports, car rental stations, and other commercial establishments. A consumer may slip a credit card into an appropriate receptacle 25 and consult a monitor 27 in selecting, for example, the desired hotel room. A protective cabinet 11 permits a number of racks to be installed and to be contained as part of a unit in conjunction with an internal computer system. The racks 12, 14 and 16 may be slid out of the cabinet 11 on rails 15 for maintenance or reloading through a door 13.

Figure 2:
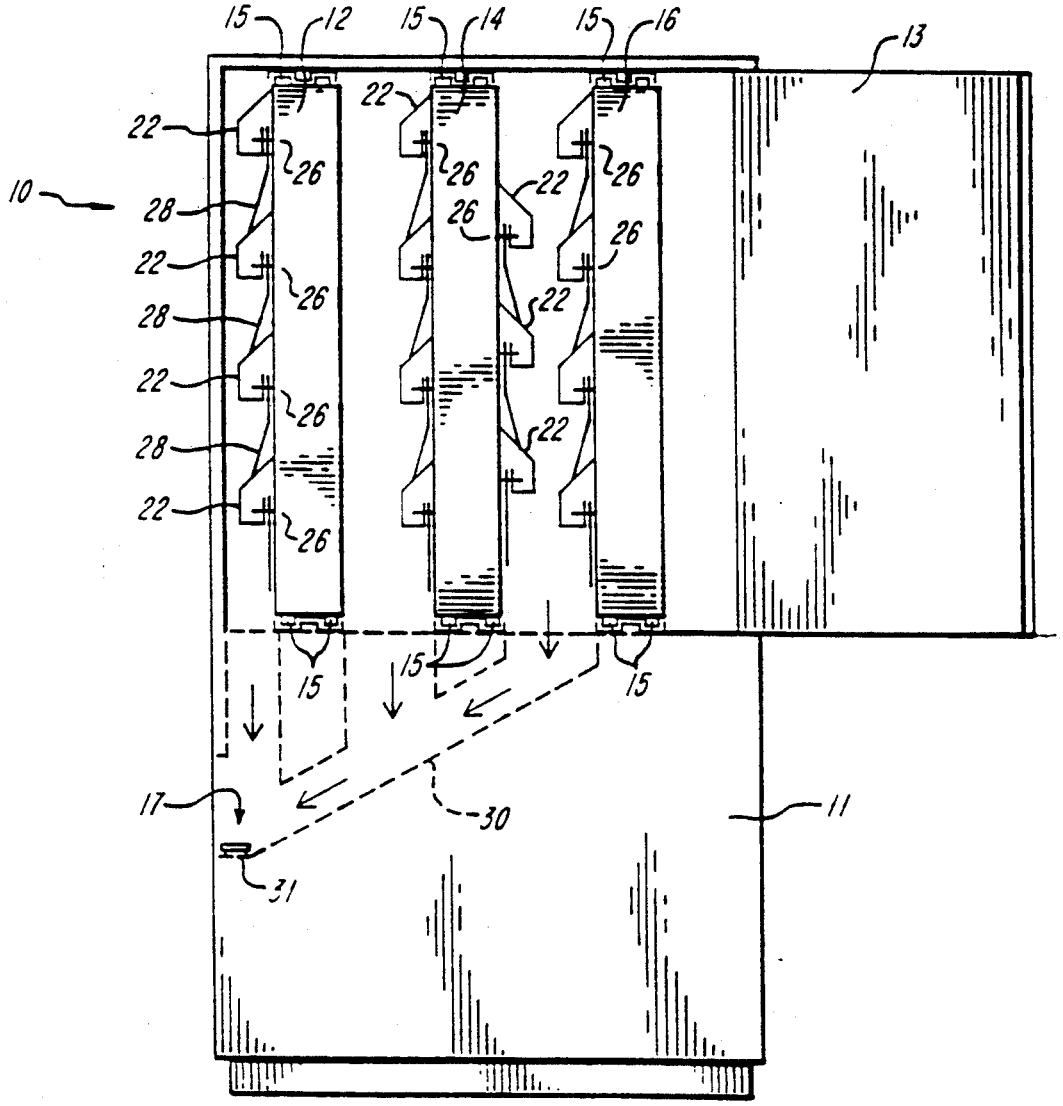
FIG. 2 is an end view of the racks of FIG. 1.

FIG. 2 is an end view of the racks 12, 14 and 16 disposed within the cabinet 11 of FIG. 1. The racks are disposed over a chute 30 or collection channel which is positioned to collect dropped keys 28 and direct them to a common accessible opening 17 where they can be obtained by a user. Awning-shaped covers 22 are operative for preventing interference among keys 28 when a key is released and dropped downwards into the collection chute 30. The covers 22 are also operative for retaining keys 28 and/or identification tag connected to the keys 28 on the keyholders 26 or posts. The covers also provide protection against tampering, such as by shaking or tilting of the machine, to prevent dislodgement of the keys 28. Key sensor 31 detects a dispensed key in opening 17 and reports the same to the system controller described herein. A suitable sensor includes an acoustic sensor manufactured by Atochem Sensors, Inc. of Valley Forge, Pa.

Although racks 12 and 16 are shown with keyholders on only one side of the racks, it is contemplated that the racks include keyholders 26 and awning-shaped covers 22 on two opposite sides of the rack as shown on rack 14.

Figure 3:
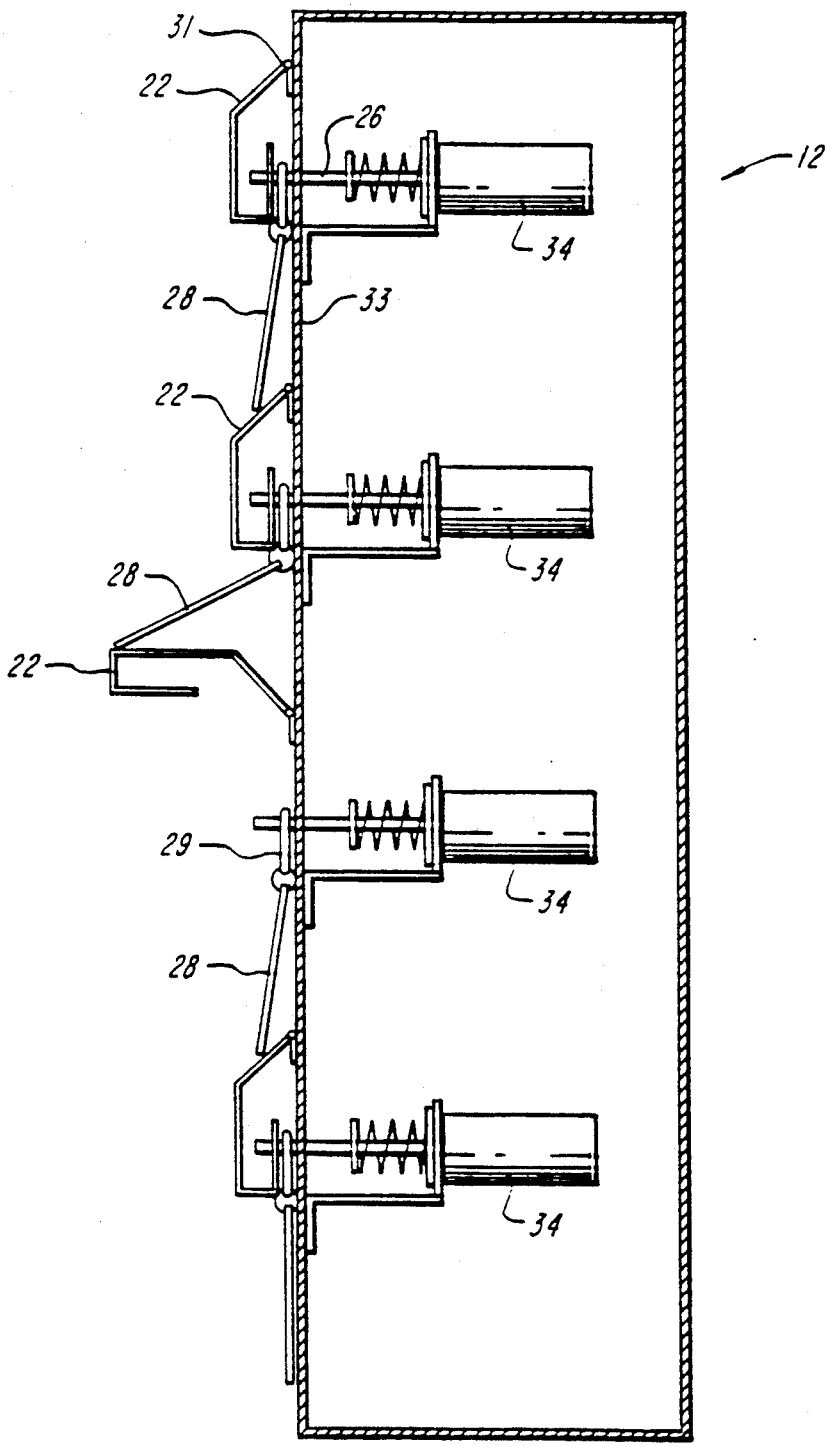
FIG. 3 is a cross-sectional view of an exemplary rack.

FIG. 3 is a cross-sectional view along a vertical column of an exemplary rack 12 of the invention upon which keys 28 having identification tags 29 have been hung. The awning-shaped covers 22 are hinged about a horizontal axis 31 to permit the covers to be hinged open upwards and to permit ready access to the keyholding posts 26. The posts 26 are movable between an extended position, whereby a key 28 or key tag 29 may be hung adjacent the front panel 33 of the rack 12, and a withdrawn position, whereby a key 28 is dropped, by a solenoid 34 mounted to the rack.

Figure 4:
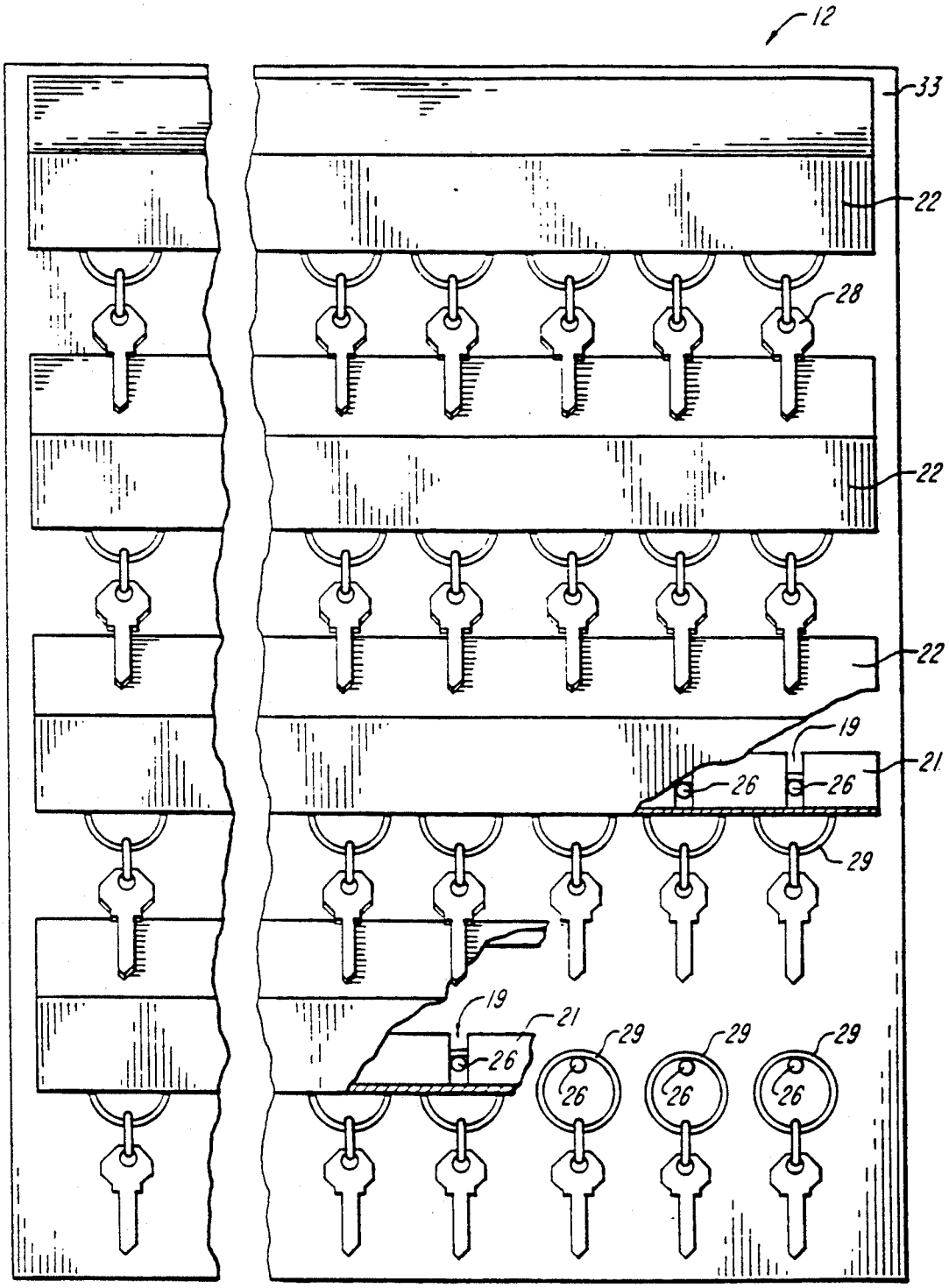
FIG. 4 is a front plan view of the rack of FIG. 3.

FIG. 4 shows an exemplary rack 12 which typically includes 4 rows and 8 columns of keys. The awning-shaped covers 22 are closed upon keys 28 which are hung on individual posts 26 by key tag 29. An internal surface 21 of the awning-shaped covers 22 has an opening 19 conformed to receive the post 26.

The rack system of the invention permits two or more racks to be placed adjacent to each other, such as one on top of the other, or side by side. The ability of the racks to permit horizontal and vertical arrangement of keys on one or two sides of the racks allows the racks to be used manually in a conventional manner such as during the hours that a reservation desk is manned, for hanging keys and permitting ready visual inspection of the keys. During the night or off-hours, the racks can then be slid or otherwise returned into a protective cabinet 11, as shown in FIG. 1, and automatically dispensed to late-night customers. The racks are connected to a common control unit by means of a flat ribbon cable although other types of interconnection means are contemplated by this invention.

Figure 5:
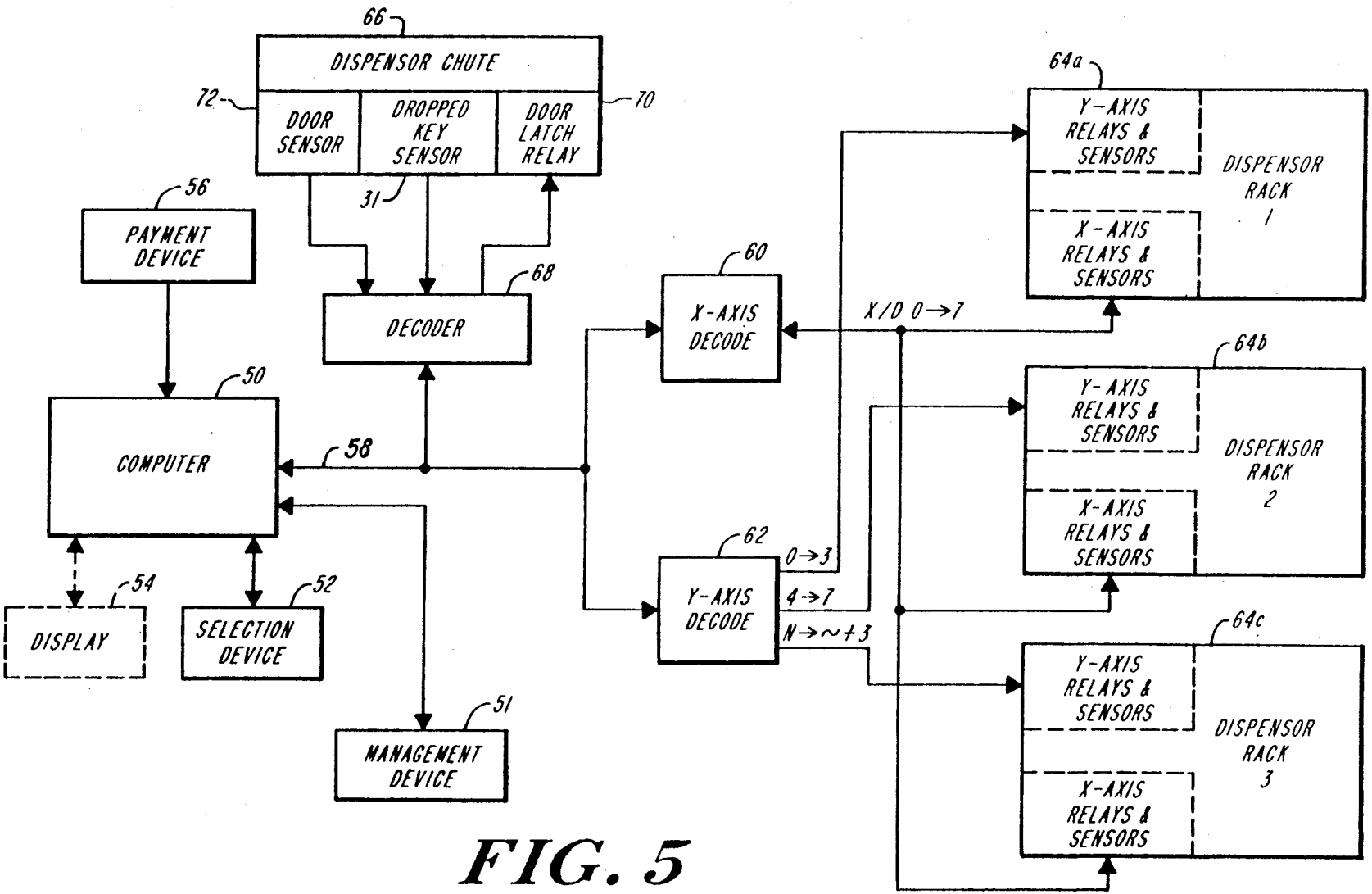
FIG. 5 is a block diagram of the key dispensing system of the present invention.

FIG. 5 illustrates a block diagram of an exemplary automated key dispensing system according to the present invention including a conventional computer 50 which controls the operation of the system. Computer 50 is responsive to user selections input on selection device 52 which may include a keyboard or touch sensitive panel. In a preferred embodiment, the system includes a display monitor 54 through which instructions are conveyed to the user.

The system manager or unit attendant must first load the keys onto the key dispensers. The keys may be randomly loaded. After loading the keys, computer 50 is instructed as to which key is on which key dispenser by means of management device 51. The management device 51 may include a hand held input terminal which is later coupled to computer 50 and information downloaded, or a terminal or personal computer which is similarly coupled to computer 50.

Utilizing monitor 54 and selection device 52, a user responds to questions such as how many beds are required in a room, which floor he wishes the room to be on and other such hotel amenities or what size and type car the user desires, all of which will allow the system to select an appropriate room, car, etc. for the user from among available rooms, cars, etc. which meet this criteria and ultimately dispense the appropriate key.

After the user has entered his selection, for example, a particular type room requested in the hotel, the user enters the proper payment for the room through payment device 56 which may include a credit card unit as well as a cash accepting unit. Computer 50 communicates with the payment device 56 as well as other various devices by means of an interface, such as an RS232 protocol interface, or other similar interface. After the appropriate selection has been made and payment received, computer 50 selects an available room and outputs key dispensing data over data path 58.

The key dispensing data is received by X and Y axis decoders 60 and 62, respectively. X and Y axis decoders 60 and 62 transmit decoded X and Y axis key dispensing codes to the appropriate one of key dispenser modules or racks 64*a*–64*c*. The decoded X and Y coordinate key dispensing codes selectively activate one and only one relay within the system to dispense a predetermined key.

Key dispensing data from data path 58 is also provided to dispenser door 66 through decoder 68 to enable the door latch relay 70 which allows the user access to the bin in which a key is dispensed. In addition, dispenser door 66 also includes door sensor 72 for sensing the open position of the door. Door position information from sensor 72 is utilized by computer 50 to determine the appropriate time to de-activate door latch relay 70 after a key has been dispensed and retrieved by the user. The dropped key is sensed by the key sensor 31 which transmits this information through decoder 6 to the computer 50 over data path 58.

Figure 6:
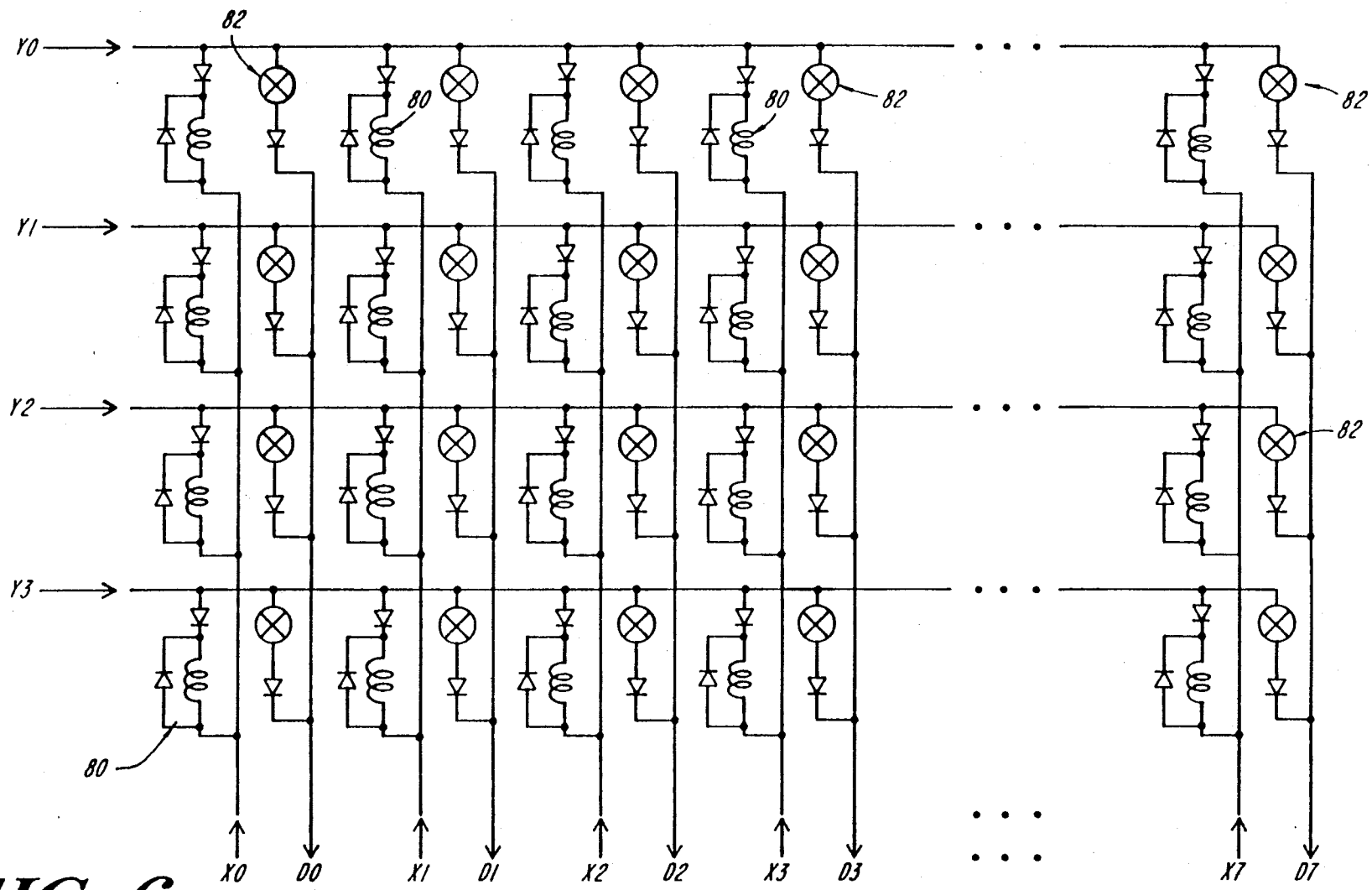
FIG. 6 is a schematic diagram of the wiring of individual solenoid controls in an exemplary key dispenser rack.

A schematic diagram illustrating an exemplary key dispenser solenoid arrangement is shown in FIG. 6 and includes a plurality of solenoids such as solenoids 80 which in the exemplary system are arranged in four rows (Y0–Y3) and eight columns (X0–X7). As previously stated, once the user enters a particular selection, the computer issues appropriate key dispensing data which is decoded into X and Y coordinates. Thus, it is the combination of an X and Y control signal which activates one and only one key dispensing relay.

An additional embodiment contemplates providing a key sensor 82 proximate each key. In such an embodiment, a row of eight sensor signals are enabled by the Y axis decoder 62. An eight bit output work is then read through the eight data signals D0–D7, and fed back to computer 50. This information is then utilized by the system to keep track of which keys have been dispensed by the presence or absence of the corresponding key sensor signal bit.

Suitable key sensors include a microswitch on a hinged keyholder post 26 in the case of a metal key, or an optical sensor in the case of plastic or metal keys. Such sensors are well known to those skilled in the art.

Modifications and substitutions by one of ordinary skill in the art are considered to be within the scope of the present invention which is no to be limited except by the claims which follow.

I claim:

1. An automatic key dispensing system, comprising:

at least one rack body;

a plurality of individual key holders arranged horizontally and vertically on said rack body, each of said key holders movable between two states, the first wherein a key is retained, the second wherein a key is released;

means for actuating said key holders between said two states;

means for directing to a common location keys released from said key holders; and awning-shaped covers associated with said rack body and disposed over said individual key holders, said covers comprising a first portion operative to retain keys on said individual key holders and a second portion unitary with said first portion comprising a deflective surface extending away from said rack body to prevent interference among keys.

2. The system of claim 1 wherein said plurality of individual key holders are arranged in at least two vertical columns and in at least two horizontal rows.

3. The system of claim 1 further comprising:

said plurality of key holders shaped as pins which are movable linearly between said two states; and solenoid valves, operative to actuate said key holders between said two states wherein individual keys are retained or released.

4. The system of claim wherein said means for directing comprises a chute aligned beneath said plurality of key holders, whereby released keys are channeled to a common location.

5. The system of claim 4 wherein said common location includes a dispensed key sensor, for indicating the presence of a dispensed key in said common location.

6. The system of claim 1 wherein said awning-shaped covers are hinged along a horizontal axis operative to permit said covers to prevent accidental dislodgement of keys when said covers are hinged into a closed position and to permit removal of keys when said covers are hinged into an open position.

7. The system of claim 1 further comprising a logic unit and said actuating means is responsive to said logic unit, whereby selected individual key holders are actuated between said two states.

8. The system of claim 7 further comprising means for inputting data into said logic unit.

9. The system of claim 1 wherein said system is enclosed within an enclosure operative to prevent tampering with said system.

10. The system of claim 1 wherein at least two rack bodies are arranged side-by-side.

11. The system of claim further including a corresponding plurality of individual key holder sensors, one of said sensors proximate each of said plurality of individual key holders, for providing an indicia of the presence or absence of a key on each of said plurality of individual key holders.

12. The system of claim 1 wherein said plurality of keyholders are arranged horizontally and vertically on two opposite sides of said at least one rack body.

13. The system of claim 8 wherein said data includes user selection data entered by a user.

14. The system of claim 8 wherein said data includes key type data entered by a system administrator.

15. The system of claim 14 wherein said data further includes key location data, for identifying each location on said rack with corresponding key type date.

16. The system of claim 13 wherein said logic unit is responsive to said user selection data, for actuating a selected one of said individual keyholders.

17. A user selectable automatic key dispensing system, comprising:

a housing;

at least one horizontally and vertically extending rack body slidable with respect to said housing;

a plurality of individual keyholders arranged horizontally and vertically on said rack body, each of said keyholders movable between two states, a first state wherein a key is retained, and a second state wherein a key is released;

means for receiving user selections;

means, responsive to said means for receiving user selections, for transforming said user selections into key dispensing data;

means, responsive to said key dispensing data, for actuating a selected one of said keyholders between said first state and said second state, thereby dispensing a selected key;

means for directing to a common location said selected key released from said keyholders; and awning-shaped covers having a deflective surface extending outwardly away from said rack body and over said individual keyholders, for retaining keys on said individual keyholders and for preventing interference between a dispensed selected key and said plurality of individual keyholders.

18. The system of claim 17 wherein said means for receiving user selections includes a keypad.

19. The system of claim 17 wherein said means for transforming said user selections into key dispensing data includes a central processing unit.

20. The system of claim 17 further including means for displaying system operating instructions to a user.

21. The system of claim 20 wherein said means for displaying includes a display monitor.

22. The system of claim 17 further including a corresponding plurality of individual key holder sensors, for providing an indicia of the presence or absence of a key on each of said plurality of individual keyholders.

23. The system of claim 17 further including means, disposed proximate said common location, for sensing the presence of a dispensed selected key in said common location.

* * * * *

UNITED STATES PATENT AND TRADEMARK OFFICE

CERTIFICATE OF CORRECTION

PATENT NO. : 5,172,829

DATED : December 22, 1992

INVENTOR(S) : Henry A. Dellicker, Jr.

It is certified that error appears in the above-indentified patent and that said Letters Patent is hereby corrected as shown below:

Column 1, line 39/40, "access modular" should read --access, modular--.

Column 4, line 42, "no to be" should read --not to be--.

Column 5, line 4, "claim wherein" should read --claim 1 wherein--.

Column 5, line 31, "claim further" should read --claim 1 further--.

Column 5, line 47, "date" should read --data--.

Signed and Sealed this

Tenth Day of May, 1994

Bruce Lehman

*Attest:*

BRUCE LEHMAN

*Attesting Officer*

*Commissioner of Patents and Trademarks*